US006651455B1

(12) United States Patent
Yoho, Sr.

(10) Patent No.: US 6,651,455 B1
(45) Date of Patent: Nov. 25, 2003

(54) EVAPORATIVE CONDENSER SYSTEM

(76) Inventor: Robert W. Yoho, Sr., 13799 Park Blvd., Suite 260, Seminole, FL (US) 33776

( * ) Notice: Subject to any disclaimer, the term of this patent is extended or adjusted under 35 U.S.C. 154(b) by 0 days.

(21) Appl. No.: 10/244,936

(22) Filed: Sep. 16, 2002

(51) Int. Cl.[7] ..... F28D 5/00; F25B 39/04
(52) U.S. Cl. ..... 62/305; 62/506
(58) Field of Search ..... 62/305, 506

(56) References Cited

U.S. PATENT DOCUMENTS 2,919,559 A * 1/1960 Koch ..... 62/305
2,995,018 A * 8/1961 Dempsey, Jr. ..... 62/305
4,757,695 A * 7/1988 Malnar ..... 62/305
5,946,932 A * 9/1999 Wang ..... 62/305
6,463,751 B1 * 10/2002 Teller ..... 62/305

* cited by examiner

*Primary Examiner*—William E. Tapolcai
(74) *Attorney, Agent, or Firm*—Edward P. Dutkiewicz

(57) ABSTRACT

An evaporative condenser system has an air handler with an input end and an output end with a fan to facilitate the movement of the air. An air cooler has at least one conical spiral coil having a top end and a bottom end, each with linear extents in the output ends and the input ends of the air handler. A pump moves a working fluid through the coil. A cooling water pathway has a water recycle input and a reservoir for the cooling water adjacent to the bottom end of the air cooler coils. The reservoir has a submersible sump pump for moving the cooling water to an elevated location with a sprayer.

1 Claim, 1 Drawing Sheet

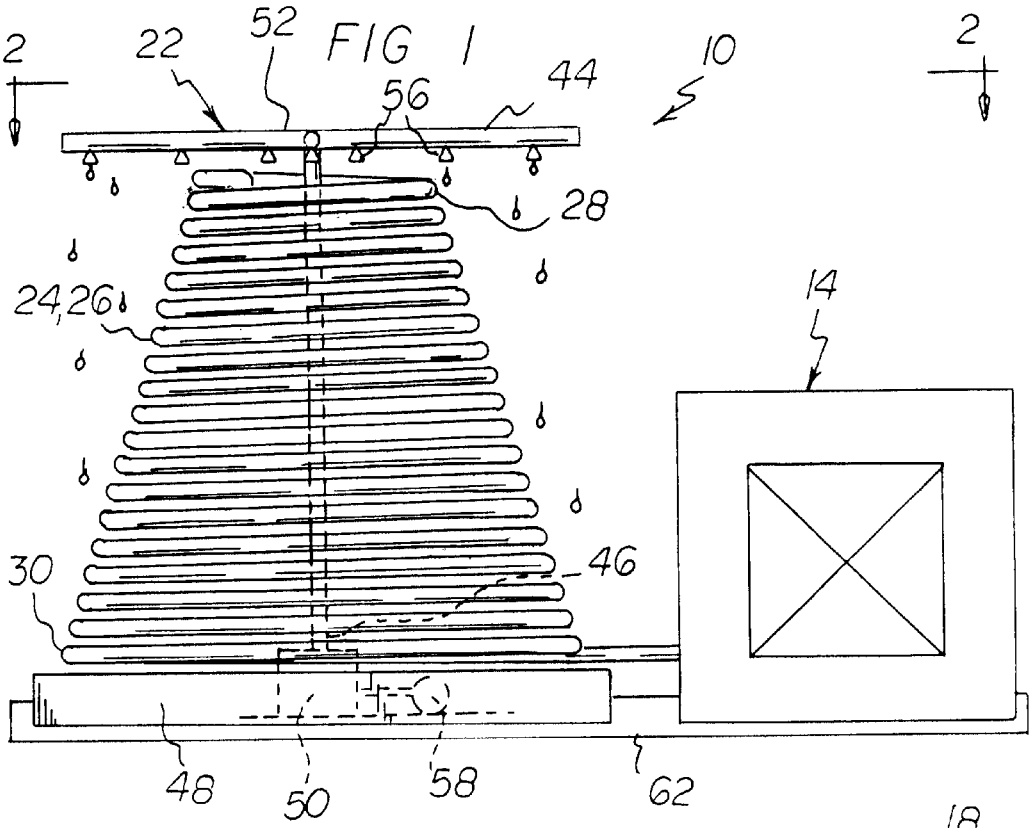
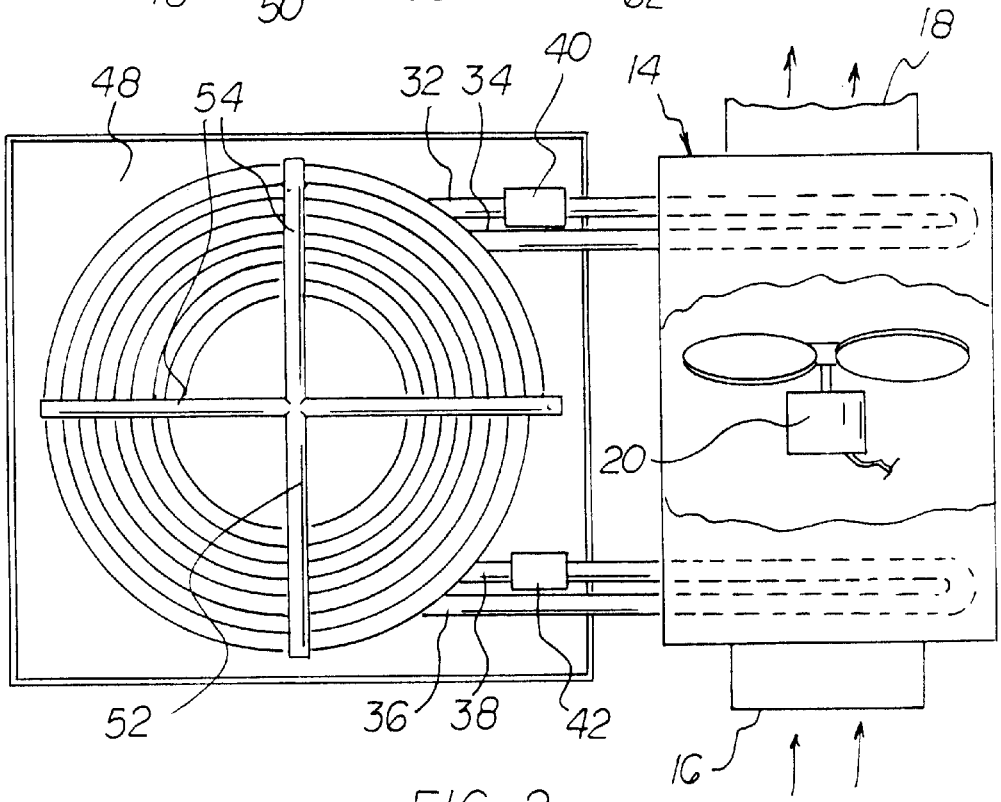
FIG 2

EVAPORATIVE CONDENSER SYSTEM

BACKGROUND OF THE INVENTION

1. Field of the Invention

The present invention relates to an evaporative condenser system and more particularly pertains to cooling refrigerant as part of an air conditioning system.

2. Description of the Prior Art

The use of condensers of known designs and configurations is known in the prior art. More specifically, condensers of known designs and configurations previously devised and utilized for the purpose of cooling refrigerants and air through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,212,571 to Romanos discloses a tube bundle for shell and tube type heat exchanger formed of spirally wound coil segments. U.S. Pat. No. 5,183,102 to Clark discloses a heating and cooling system. Lastly, U.S. Pat. No. 5,622,055 to Mei et al. discloses a liquid over-feeding refrigeration system and method with integrated accumulator-expander-heat exchanger.

While these devices fulfill their respective, particular objectives and requirements, the aforementioned patents do not describe an evaporative condenser system that allows cooling refrigerant as part of an air conditioning system.

In this respect, the evaporative condenser system according to the present invention'substantially departs from the conventional concepts and designs of the prior art, and in doing so provides an apparatus primarily developed for the purpose of cooling refrigerant as part of an air conditioning system.

Therefore, it can be appreciated that there exists a continuing need for a new and improved evaporative condenser system which can be used for cooling refrigerant as part of an air conditioning system. In this regard, the present invention substantially fulfills this need.

SUMMARY OF THE INVENTION

In view of the foregoing disadvantages inherent in the known types of condensers of known designs and configurations now present in the prior art, the present invention provides an improved evaporative condenser system. As such, the general purpose of the present invention, which will be described subsequently in greater detail, is to provide a new and improved evaporative condenser system and method which has all the advantages of the prior art and none of the disadvantages.

To attain this, the present invention essentially comprises an air handler. The air handler has an input end and an output end. A fan is provided to facilitate the movement of the air to be cooled through the air handler. Next provided is an air cooler. The air cooler comprises two plastic conical spiral coils. The coils have a top end and a bottom end. Each of the coils has linear extents in the output ends and the input ends of the air handler. The coils form an angle of between about 5 and 15 degrees from the vertical and are spaced for allowing air cooling water to circulate between the spiral coil. A working fluid selected from the class of working fluids including water, alcohol and freon is provided. The working fluid is in the coils. Pumps independently move the working fluid through the coils. A cooling water pathway is next provided. The cooling water pathway has a water recycle input end. A reservoir is provided for the cooling water adjacent to the bottom end of the air cooler coils. The reservoir has a submersible sump pump for moving the cooling water to an elevated location with a sprayer. The sprayer includes four plastic wands. Each want has a plurality of downwardly facing slots. The cooling water is released from the sprayer through the slots and bathes the coils of the air cooler, absorbing the heat from the coils. In this manner, the air in the secondary input is made cooler than the air of the secondary output. The spent water continuously collects in the reservoir. Next provided is a ball valve. The ball valve continuously maintains the depth of water in the reservoir at an appropriate level by activating and inactivating the sump pump. Lastly, a housing is provided. The housing receives and supports the air handler and air cooler.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved evaporative condenser system which has all of the advantages of the prior art condensers of known designs and configurations and none of the disadvantages.

It is another object of the present invention to provide a new and improved evaporative condenser system which may be easily and efficiently manufactured and marketed.

It is further an object of the present invention to provide a new and improved evaporative condenser system which is of durable and reliable constructions.

An even further object of the present invention is to provide a new and improved evaporative condenser system which is susceptible of a low cost of manufacture with regard to both materials and labor, and which accordingly is then susceptible of low prices of sale to the consuming public, thereby making such evaporative condenser system economically available to the buying public.

Even still another object of the present invention is to provide an evaporative condenser system for cooling refrigerant as part of an air conditioning system.

Lastly, it is an object of the present invention to provide a new and improved evaporative condenser system having an air handler with an input end and an output end with a fan to facilitate the movement of the air, an air cooler having at least one conical spiral coil with a top end and a bottom end, each with linear extents in the output ends and the input ends of the air handler, a pump to move a working fluid through the coil, a cooling water pathway having a water recycle input and a reservoir for the cooling water adjacent to the bottom end of the air cooler coils, and a submersible sump pump for moving the cooling water to an elevated location with a sprayer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the evaporative condenser system constructed in accordance with the principles of the present invention.

FIG. 2 is a plan view of the system taken along line 202 of FIG. 1.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved evaporative condenser system embodying the principles and concepts of the present invention and generally designated by the reference numeral 10 will be described.

The present invention, the evaporative condenser system 10 is comprised of a plurality of components. Such components in their broadest context include an air handler, air cooler, and a cooling water pathway. Such components are individually configured and correlated with respect to each other so as to attain the desired objective.

First provided is an air handler 14. The air handler has an input end 16 and an output end 18. A fan 20 is provided to facilitate the movement of the air to be cooled through the air handler.

Next provided is an air cooler 22. The air cooler comprises two plastic conical spiral coils 24, 26. The coils have a top end 28 and a bottom end 30. Each of the coils has linear extents 32, 34 36, 38 in the output ends and the input ends of the air handler. The coils form an angle of between about 5 and 15 degrees from the vertical and are spaced for allowing air cooling water to circulate between the spiral coil.

A working fluid is next provided. The working fluid is in the coils. The working fluid is selected from the class of working fluids including water, alcohol and freon. Pumps 40, 42 independently move the working fluid through the coils.

A cooling water pathway 44 is next provided. The cooling water pathway has a water recycle input end 46. A reservoir 48 is provided for the cooling water adjacent to the bottom end of the air cooler coils. The reservoir has a submersible sump pump 50 for moving the cooling water to an elevated location with a sprayer 52. The sprayer includes four plastic wands 54. Each want has a plurality of downwardly facing slots 56. The cooling water is released from the sprayer through the slots and bathes the coils of the air cooler, absorbing the heat from the coils. In this manner, the air in the secondary input is made cooler than the air of the secondary output. The spent water continuously collects in the reservoir.

Next provided is a ball valve 58. The ball valve continuously maintains the depth of water in the reservoir at an appropriate level by activating and inactivating the sump pump.

Lastly, a housing 62 is provided. The housing receives and supports the air handler and air cooler.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. An evaporative condenser system for cooling refrigerant as part of an air conditioning system comprising, in combination:

an air handler having an input end and an output end with a fan to facilitate the movement of the air to be cooled through the air handler;

an air cooler comprising two plastic conical spiral coils having a top end and a bottom end each with linear extents in the output ends and the input ends of the air handler, the coils forming an angle of between about 5 and 15 degrees from the vertical being spaced for allowing air cooling water to circulate between the spiral coil, the coils being outside of the air handler with the linear extents being inside of the air handler;

a working fluid in the coils, the working fluid selected from the class of working fluids including water, alcohol and freon;

pumps to independently move the working fluid through the coils;

a cooling water pathway having a water recycle input end, a reservoir for the cooling water adjacent to the bottom end of the air cooler coils, the reservoir having a submersible sump pump for moving the cooling water to an elevated location with a sprayer, the sprayer including four plastic wands each having a plurality of downwardly facing slots from which the cooling water is released from the sprayer and bathes the coils of the air cooler and absorbs the heat from the coils, thereby making the air in the secondary input cooler than the air of the secondary output, the spent water adapted to continuously collect in the reservoir;

a ball valve to continuously maintain the depth of water in the reservoir at an appropriate level by activating and inactivating the sump pump; and a housing to receive and support the air handler and air cooler.

* * * * *